US005644827A

United States Patent [19]

Alcobia

[11] Patent Number: 5,644,827

[45] Date of Patent: Jul. 8, 1997

[54] APPARATUS FOR INSTALLING AND REMOVING PISTON RODS

[76] Inventor: Ed Alcobia, 2244 Weatherby Ave., Escondido, Calif. 92027

[21] Appl. No.: 154,900

[22] Filed: Nov. 19, 1993

[51] Int. Cl.[6] ..... B25B 27/00

[52] U.S. Cl. ..... 29/270; 29/275; 29/278

[58] Field of Search ..... 294/99.2, 99.1, 294/8.5, 11; 29/270, 278, 280, 275, 283, 271

[56] References Cited

U.S. PATENT DOCUMENTS 3,713,685 1/1973 Ewing ..... 294/99.1

*Primary Examiner*—Robert C. Watson

[57] ABSTRACT

An apparatus for removing and installing piston rods from an internal combustion engine that prevents metal to metal contact between the piston rod and other engine components. The apparatus disclosed is a piston rod guide which includes two hollow legs that are spaced sufficiently apart such that each hollow leg fits on either side of the crankshaft and sufficiently close such that the hollow legs can pass through the cylinder bore. Each hollow leg has a large enough inside diameter that a piston rod bolt can be fit inside. The apparatus disclosed is straddled over the engine's crankshaft and each hollow leg pushed onto a piston rod bolt. The piston rod can now be installed or removed without damaging metal to metal contact between the piston rod and internal parts of the engine as the apparatus guides the piston rod through the cylinder bore. During installation, the apparatus further restricts the piston rod bolts to align themselves over the crankshaft.

5 Claims, 2 Drawing Sheets

APPARATUS FOR INSTALLING AND REMOVING PISTON RODS

BACKGROUND OF THE INVENTION

1. Field of the Invention

The present invention relates to a method and an apparatus for the installation and removal of a piston rod from a cylinder bore of an internal combustion engine.

2. Discussion of the Related Art

A majority of internal combustion engines require internal servicing for repair at some point in their useful lives. In addition, servicing and replacement of worn internal engine parts can greatly extend an otherwise worn out engine's life. Internal servicing and parts replacement may, and typically will, require removing the piston and piston rods from the engine. This internal servicing may be required as part of a repair or replacement of the pistons, the piston rods themselves, the crank bearings, or some other engine parts and equipment. Separating a piston rod from an engine's cranking means and removing it through its associated cylinder bore or installing a piston rod through a cylinder bore and connecting it to the engine's cranking means is a typical internal servicing operation performed by the professional as well as the backyard mechanic.

When performing an installation or removal of a piston rod from an internal combustion engine, a major concern is metal to metal contact. Typically, the base or the bolts on the piston rod will fall against, and slide along, the bearing surface of the engines cranking means and against the cylinder bore wall. This metal to metal scraping can scar and damage the cylinder bore wall, the bearing surfaces on the engine's cranking means and the piston rod bolts. Further, the scraping can leave metal shavings in the engine's interior which can cause wear and damage during operation. There is also the chance that the piston rod will become caught inside the cylinder bore, requiring hammering on the piston head, which can lead to a cracked cylinder bore or broken piston.

The most common technique for removing a piston rod from an engine is accomplished by a mechanic or one with mechanical and automotive skills. The engine is first separated or removed from the automobile, boat or other vehicle which it powered. The engine is disassembled to expose the cranking means or more specifically, the connection of the piston rods to the cranking means or crankshaft. The piston rod is then disconnected from the engine's crankshaft by removing the fasteners, typically rod nuts, from the rod bolts, removing the lower seat of the piston rod and leaving the rod bolts exposed. The mechanic can now remove the piston and attached piston rod from the crankshaft and engine by pushing it out of its associated cylinder bore. As the piston rod is slid off of the engine's crankshaft, the piston rod bolts can scrape against the crankshaft, scarring the bearing surfaces, damaging the rod bolt threads and leaving metal shavings inside the engine block. As the piston rod is slid further out of the engine through the cylinder bore, the piston rod base and bolts can fall against and scrape the cylinder bore wall. This scraping can damage the finished piston ring and cylinder bore wall contact surface, the piston rod bolts, and also leave metal filing inside the engine. Thus, a second person is often required during removal of piston rods to support the piston rod and prevent its contact with other parts of the engine.

To replace the piston and attached piston rod, the sequence is reversed. The piston rod is placed, rod bolts first, into the cylinder bore and then pushed into the cylinder bore until the rod bolts contact the engine's cranking means or crankshaft. The rod bolts are then directed to straddle the engine's crankshaft until the base of the piston rod seats against the crankshaft. A second person is often required to ensure that the piston rod does not scrap or contact the cylinder bore as it is being inserted and pushed into the cylinder bore. Also, the second person can direct the piston rod bolts to straddle the crankshaft and prevent any contact with and scraping of the crankshaft.

Thus, a need exists for an apparatus that can be utilized to prevent metal to metal contact when removing or installing a piston rod into a cylinder bore and onto a crankshaft of an internal combustion engine. A need also exist for an apparatus and method that eliminates the need of an assistant when installing or removing piston rods from an engine. A need further exists for an apparatus and method that can be utilized on the majority of available internal combustion engines.

SUMMARY OF THE INVENTION

The disclosed apparatus and method of the present invention is a piston rod guide and method of use which includes two hollow legs that are spaced sufficiently apart such that each hollow leg fits on either side of the crankshaft and sufficiently close such that the hollow legs can pass through the cylinder bore. Each hollow leg has a large enough inside diameter so that a piston rod bolt can be fit inside. The apparatus disclosed is straddled over the engine's crankshaft and each hollow leg is pushed onto a piston rod bolt. The piston rod can now be installed or removed without damaging metal to metal contact between the piston rod and internal parts of the engine as the apparatus guides the piston rod through the cylinder bore. During installation, the apparatus further restricts the piston rod bolts to align themselves over the crankshaft.

It is therefore a primary objective of the present invention to provide an apparatus and method of installing and removing a piston rod from an internal combustion engine with at least one cylinder bore without allowing metal to metal contact of the piston rod with other surfaces within the engine.

It is another object of the present invention to provide an apparatus and method for installing and removing a piston rod from an internal combustion engine with at least one cylinder bore, without allowing metal to metal contact, that eliminates the need for assistance by a second person.

It is another object of the present invention to provide an apparatus and method for installing and removing a piston rod from an internal combustion engine without metal to metal contact that is very reliable and simple to use.

It is another object of the present invention to provide an apparatus for installing and removing a piston rod from an internal combustion engine without metal to metal contact that has few parts, is lightweight and inexpensive to manufacture.

It is another object of the present invention to provide an apparatus for installing and removing a piston rod from an internal combustion engine with at least one cylinder bore without metal to metal contact that is resistant to grease and other compounds typical to internal combustion engines and is simple to clean.

These and other objects, features, and advantages of the described invention together with the operation of the invention will be understood by reference to the following detailed description taken together with the drawings.

BRIEF DESCRIPTION OF THE DRAWINGS

A preferred form of the present invention is illustrated in the accompanying drawings in which.

DETAILED DESCRIPTION OF THE PREFERRED EMBODIMENT

Figure 1:
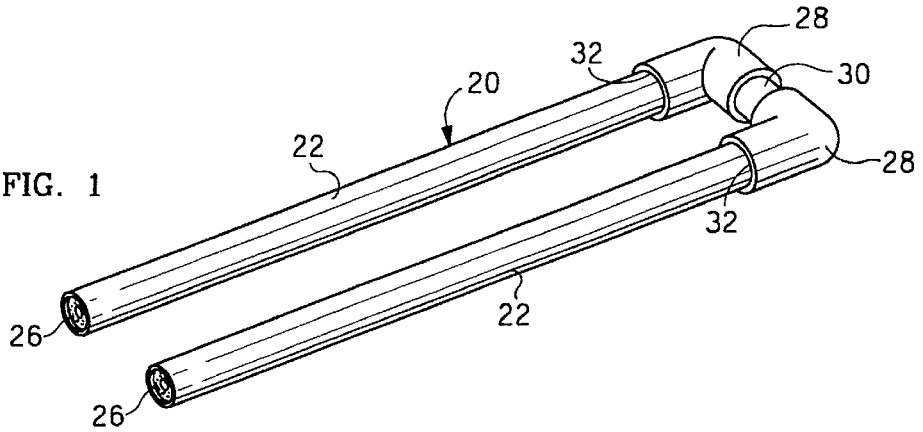
FIG. 1 is a perspective view of the apparatus for installing or removing a piston rod from an internal combustion engine according to the present invention.
Figure 4:
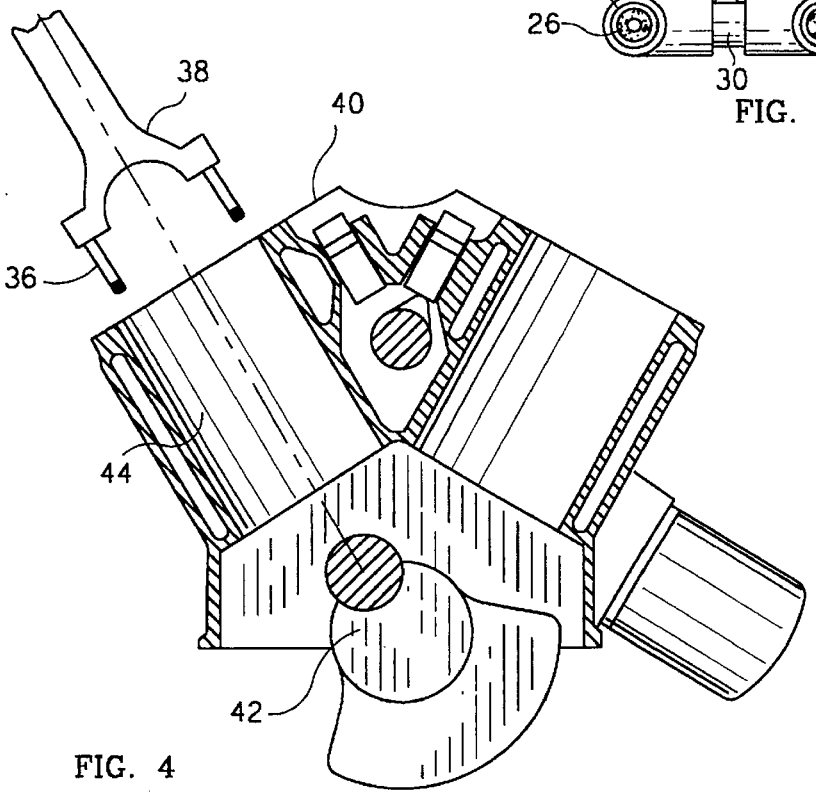
FIG. 4 is a cross sectional view of a piston rod and a typical internal combustion engine, showing the piston rod separated from the engine's cranking means and removed from the engine.

Referring to the drawings and more particularly to FIGS. 1, and 4, the preferred embodiment of the present apparatus for installing or removing a piston rod 38 from an internal combustion engine 40 with at least one cylinder bore 44 will be described. The piston rod guide 20 of the present invention includes a pair of nonmetal hollow legs 22, a cross member 30, and a pair of unions 28 that connect the hollow legs 22 to the cross member 30.

Figure 2:
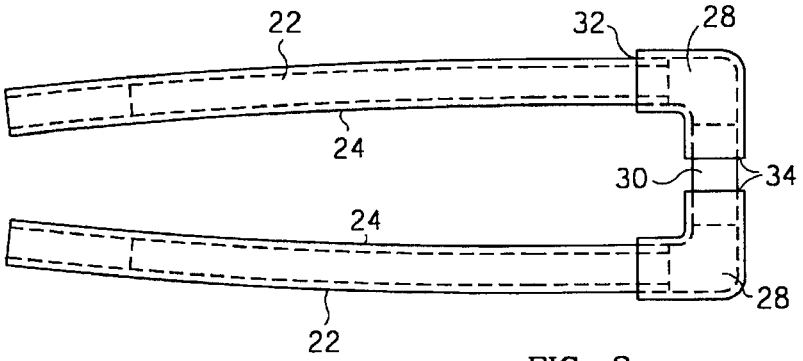
FIG. 2 is a top view of the apparatus for installing or removing a piston rod from an internal combustion engine according to the present invention.

Referring now to FIG. 2, each hollow leg 22 is fixed to an angular union 28 at a joint 32. The opposite ends of the angular unions 28 are connected to a cross member 30 at joints 34. The joints 32 are tightly fitted or permanently restrained to prevent release during use. The joints 34 are also tightly fitted to prevent release during use but not permanently fixed such that separation for changing to a different length of cross member 30 is possible.

Figure 3:
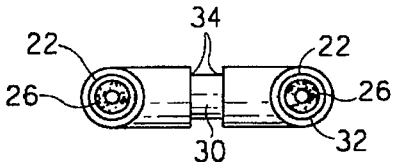
FIG. 3 is a front view of the apparatus for installing or removing a piston rod from an internal combustion engine showing a means of retaining the rod bolts inside the hollow legs.

Referring now to FIGS. 2 and 4, each hollow leg 22 has a curved section 24 that acts to provide a force on the piston rod bolts 36 and retain them within the hollow legs 22 during use. With respect to FIG. 3, a bolt retainer 26 made of an elastic material such as rubber that is fixed inside the end of each hollow leg 22 as an additional means of restraining the piston rod bolts 36 within the hollow legs 22 during use.

Figure 5:
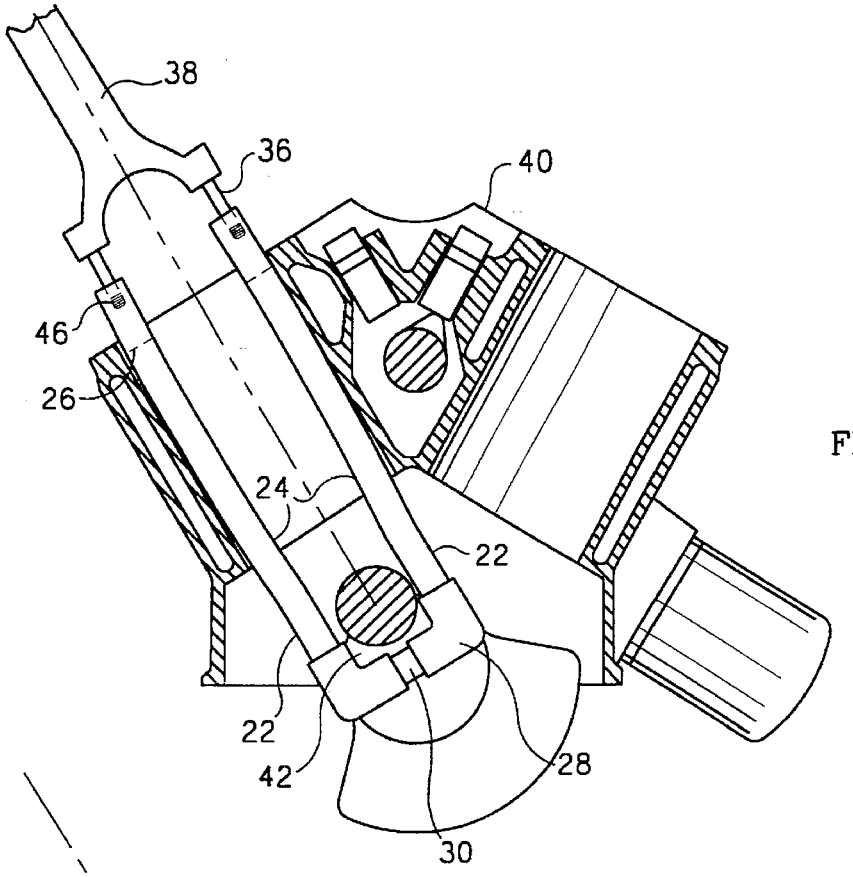
FIG. 5 is cross sectional view of the apparatus for installing or removing a piston rod and an internal combustion engine, showing the apparatus attached to the piston rod bolts, straddling the engine's crankshaft and fully inserted through the cylinder bore of the engine.
Figure 6:
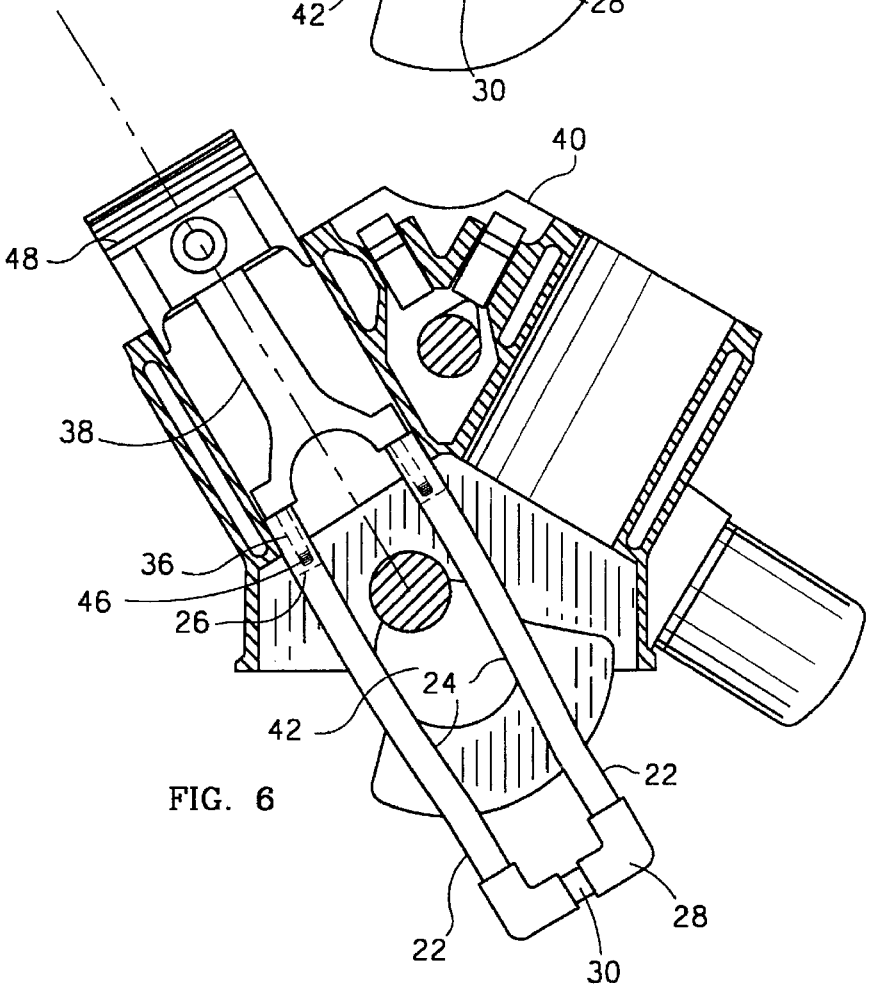
FIG. 6 is cross sectional view of the apparatus for installing or removing a piston rod and an internal combustion engine, showing the apparatus attached to the piston rod bolts, straddling the engine's crankshaft and partially retracted from the cylinder bore of the engine.

Referring to FIGS. 5 and 6, the preferred method and apparatus of the present invention will be described. The removal of a piston 48 and attached piston rod 38 from the engine 40 is accomplished by a mechanic or one with mechanical and automotive skills. The engine 40 is first separated or removed from the automobile, boat or other vehicle (not shown) which it powers. The engine 40 is then disassembled to expose the crankshaft 42, or more specifically, the connection of the piston rods 38 to the crankshaft 42. The piston rod 38 is then disconnected from the crankshaft 42 by removing the piston rod bolts (not shown) from the rod bolts 36, removing the lower seat of the piston rod (not shown) and leaving the piston rod bolts 36 exposed. The piston rod guide 20 is inserted into the engine 40 such that each hollow leg 22 straddles the crankshaft 42 and a piston rod bolt 36 is inserted into each of the hollow bolt retainers 26. The mechanic can now remove the piston rod 38 from the crankshaft 42 and out of the engine 40 by pushing on the base of the piston rod guide 22 until the piston rod bolts 36 are completely clear of the cylinder bore 44. The piston rod guide 20 can be removed from the piston rod bolts 36 by bending the curved hollow legs 22 to release the pressure being exerted onto the piston rod bolts 36 and releasing the bolt retainers 26 from the piston rod bolt threads 46. The next piston 48 and piston rod 38 can now be removed.

To replace the piston 48 and attached piston rod 38, the disclosed method is reversed. The piston rod guide 20 is fully inserted into the engine 40 so that each hollow leg 22 straddles the crankshaft 42 and the cross member 30 of the piston rod guide 20 is up against the crankshaft 42. The hollow legs 22 of the piston rod guide 20 are sufficiently long such that they protrude through the cylinder bore 44 and out of the engine 40. The piston rod 38 to be installed is attached to the piston rod guide 20 by inserting each piston rod bolt 36 into the rod bolt retainer 26 within each hollow leg 22. The piston 48 and attached piston rod 38 can now be installed into the engine 40 by pushing down on the piston 48 and forcing the piston rod 38 and piston rod guide into the cylinder bore 44. As the piston rod guide 20 is pushed out of the cylinder bore 44, the piston rod bolts 36 are restrained by the hollow legs 22 to straddle the crankshaft 42. When the piston rod 38 has seated on the crankshaft 42, the piston rod guide 20 is removed from the rod bolts 36 by releasing the pressure exerted by the curved hollow legs 22 and the bolt retainers 26. The piston rod 38 is reattached to the crankshaft 42 by reassembling the lower section of the piston rod (not shown). The next piston rod 38 can now be installed.

The rod guide can be made from pvc by either injection molding or by hand assembly or it can be made from other suitable materials.

While the preferred embodiments of the invention have been described above, it will be recognized and understood that various changes and modifications may be made therein and the appended claims are intended to cover all such modifications which may fall within the spirit and scope of this invention.

What is claimed is:

1. An apparatus for installing or removing a piston rod comprising:

two legs of sufficient length to extend from below the engine's cranking means into a cylinder bore for attachment to rod bolts; one end of each said leg having a hollow portion; two angular sections one connected to each said leg; a central base section connected between said angular sections and a means of retaining rod bolts within said legs comprising an inward curved section in each of said legs, whereby said curved section exerts and retains a force on the piston rod bolts.

2. The apparatus of claim 1 wherein:

said hollow portion comprises a section of hollow elastic material fixed to the interior walls of said hollow portion, said elastic material of sufficient diameter to allow forced insertion and removal of the piston rod bolts for gripping said rod bolts.

3. The apparatus of claim 2 wherein said hollow elastic material is rubber.

4. The apparatus of claim 1 wherein said central base section is removable and replaceable from said angular sections, whereby said central base section can be exchanged for a central base section of differing length.

5. The apparatus of claim 1 wherein said apparatus is composed of material resistant to oil, grease and other compounds common to internal combustion engines.

* * * * *